United States Patent [19]

Larmit

[11] 4,127,148

[45] Nov. 28, 1978

[54] WEAVING MACHINE OF THE TYPE IN WHICH WEFT INSERTION IS EFFECTED BY A FLUID FLOW

[75] Inventor: Adrianus J. F. Larmit, Moergestel, Netherlands

[73] Assignee: Ruti-Te Strake B.V., Deurne, Netherlands

[21] Appl. No.: 879,876

[22] Filed: Feb. 22, 1978

Related U.S. Application Data

[63] Continuation-in-part of Ser. No. 794,709, May 9, 1977, abandoned, and Ser. No. 644,148, Dec. 24, 1975, abandoned.

[30] Foreign Application Priority Data

Mar. 20, 1975 [NL] Netherlands ..... 7503375

[51] Int. Cl.[2] ..... D03D 47/28

[52] U.S. Cl. ..... 139/435

[58] Field of Search ..... 139/435, 188, 190

[56] References Cited

U.S. PATENT DOCUMENTS

| | | | |
|---|---|---|---|
| 3,139,118 | 6/1964 | Svaty et al. | 139/435 |
| 3,818,952 | 6/1974 | Vermeulen | 139/435 |
| 3,911,968 | 10/1975 | Zollinger | 139/435 |
| 3,958,609 | 5/1976 | Zollinger et al. | 139/435 |

FOREIGN PATENT DOCUMENTS

| | | | |
|---|---|---|---|
| 2,600,369 | 7/1977 | Fed. Rep. of Germany | 139/435 |

*Primary Examiner*—Henry S. Jaudon
*Attorney, Agent, or Firm*—Marshall & Yeasting

[57] ABSTRACT

A weaving machine of the type in which weft insertion is effected by a fluid flow and in which a plurality of notched blades arranged closely adjacent each other in front of the reed confine a guide passage for the weft threads, said guide passage being laterally open towards the reed and being adapted to move into and out of the shed in synchronism with the reciprocation of the reed, wherein each guide passage forming blade comprises at least two spaced thin blades which are mutually connected at least at the ends at which they enter and leave the weaving shed during the reed movement.

2 Claims, 3 Drawing Figures

WEAVING MACHINE OF THE TYPE IN WHICH WEFT INSERTION IS EFFECTED BY A FLUID FLOW

CROSS-REFERENCE TO RELATED APPLICATION

This is a continuation-in-part of application Ser. No. 794,709, filed May 9, 1977 and application Ser. No. 644,148, filed Dec. 24, 1975, both now abandoned.

BACKGROUND OF THE INVENTION

The invention relates to a weaving machine of the type of which weft insertion is effected by a fluid flow and in which a plurality of notched blades arranged closely adjacent each other in front of the reed confined a guide passage for the weft threads, said guide passage being laterally open towards the reed and being adapted to move into and out of the shed in synchronism with the reciprocation of the reed.

Weaving machines of this type provided with a weft thread guiding passage formed by notched blades which are independent of the blades of the reed, are known. It is characteristic of this type of weaving machines that the reed function and the weft guiding function are fullfilled by separate means (blades) as distinguished from another well-known type of weaving loom in which both functions are united in one element viz. the reed, which for this purpose comprises notched blades having their notches facing into the beating direction.

In both types of weaving machines, apart from a main blowing nozzle, arranged at the entrance of the weaving shed, a plurality of (needle-shaped) auziliary blowing nozzles are provided spaced across the weaving width which are adapted to enter into the weaving shed when the reed is taking its retracted position. Experiments have shown that the transport of the wefts through the weaving shed and particularly the transport speed to be attained is strongly dependent on the extent to which the transport air, which has been entered into the passage by blowing, may, from oneeauxiliary blowing nozzle to the next, escape between the adjacent blades to the atmosphere, thus relieving back pressure which would retard the jets.

In a weaving machine having the reed and weft guiding functions combined in one means there is little or no freedom with respect to the dimensions of the leak paths for the transport air from the guide passage formed by the reed blades. For in such a type of weaving machine the thickness of the blades as well as their spacing is primarily determined by the type of the warp threads as well as by the setting of the warp.

With separate reed and weft guide functions there is more freedom in this respect. Therefore in practice blades having a greater thickness are used to form a weft guide passage which is separate from the reed, which blades may be arranged at a larger or smaller mutual spacing. Sometimes hollow blades are used, and the inner space of such blades may then be used as an air feed passage for an auxiliary blowing nozzle. A further advantage of this type of weaving machine is to be seen in that the temple may be positioned closer to the beating line so that there will be less tendency for the selfedges to move inwardly than in a weaving machine having combined reed and weft guide functions.

SUMMARY OF THE INVENTION

The invention provides a special structure of the weft guide passage in a weaving machine of the type initially referred to and more particularly provides a particular type of blade for such guide passage. The blade provided by the present invention has advantages in connection with manufacturing techniques and offers further possibilities of optimalizing the conditions for the transport of the weft threads through the guide passage.

According to the invention each guide passage forming blade comprises at least two spaced thin blades which are mutually connected at least at the ends at which they enter and leave the weaving shed during the reed movement.

A blade according to the present invention may be considered as a hollow blade, the inner space of which is made to communicate at predetermined positions around the delimited weft guide passage with the space outside that passage. This permits the creation of additional leak paths, the position, the length and also the width (corresponding to the mutual spacing between the elementary thin blades) of which may be varied. The "bridge" or bridges respectively between the elementary thin blades may be simply obtained by e.g. soldering or in any other suitable manner.

DESCRIPTION OF THE PREFERRED EMBODIMENTS

Figure 1:
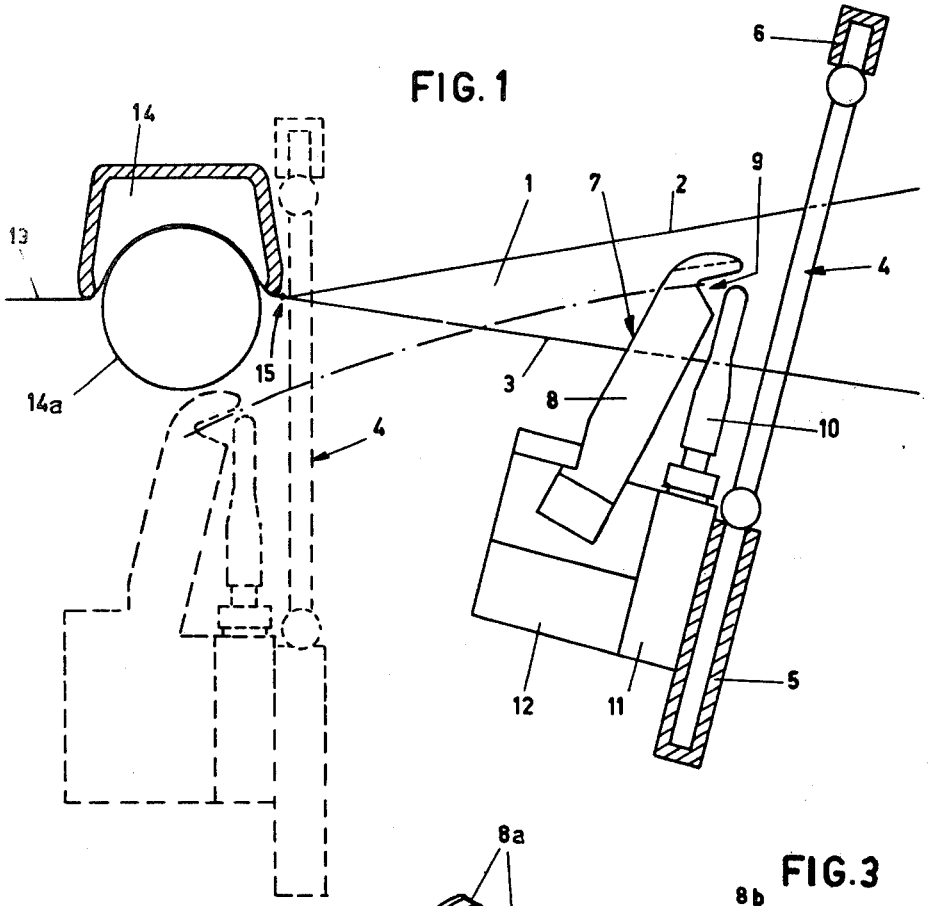
FIG. 1 is a schematic cross-section through the weaving shed, the reed and the weft guide passage arranged in front thereof, of a weaving machine according to the invention.

The weaving shed 1 is shown in FIG. 1, delimited by the upper warp threads 2, the lower warp threads 3 and the retracted reed 4.

The reed 4 is a normal reed, that is it comprises straight blades which are encased at their lower ends in a frame 5 and at their upper ends in a frame 6.

In front of the reed 4, that is at the side facing towards the beating line, a weft thread guide 7 is provided comprising a plurality of blades 8 having notches 9 facing the reed 4, said notches forming together a guide passage for transporting a weft thread through the weaving shed by means of a fluid flow. Across the width of the loom, i.e. perpendicular to the plane of the drawing, needle-shaped auxiliary blowing nozzles 10 are arranged between the blades 8 and the reed 4, the outlet openings of which (not shown in the drawing) are located in front of the lateral opening of the guide passage delimited by the notches 9 and have their axes directed to make a small angle with the longitudinal direction of said passage. The auxiliary blowing nozzles 10 and the blades 8 are mounted or encases respectively in the parts indicated at 11 and 12 mounted to the lower reed frame 5.

The cloth is indicated at 13 and the temple is indicated at 14.

While the assembly comprising the reed 4, the blades 8 and the auxiliary blowing nozzles 10 is taking the position shown in full lines, a weft thread, issuing from a main blowing nozzle situated at one end of the weaving shed and not shown in the drawing, may be transported through the guide passage delimited by the notches 9 in the blades 8 to the other end of the weaving shed. After such a weft insertion has been completed the reed 4 is moved together with the blades 8 and the auxiliary blowing nozzles 10 to the position shown in broken lines. With this movement the blades 8 and the auxiliary blowing nozzles 10 emerge through the warp threads defining the weaving shed, the blades 8 just remaining free from the part 14*a* of the temple 14 which, as shown in the drawing, is at a very short distance from the line 15 along which the reed is beating up the weft thread into the cloth.

When the reed is retracted from its beating up position the blades 8 and the auxiliary blowing nozzles 10 will enter again, through the lower warp threads of the newly formed weaving shed to a position in which the guide passage is again within the weaving shed.

Figure 2:
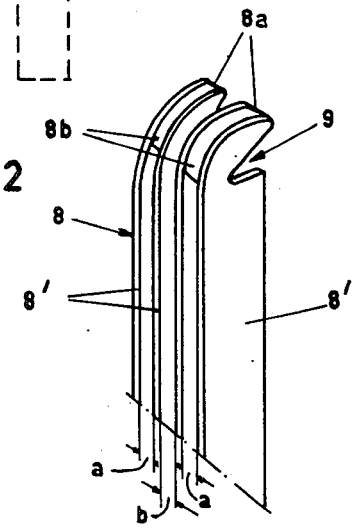
FIG. 2 is a perspective view of a blade designed to form a weft guide passage, in one embodiment according to the invention
Figure 3:
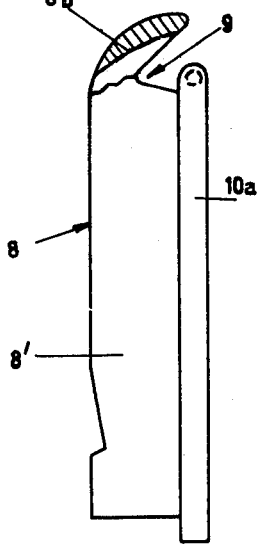
FIG. 3 is a side view, partly in section, a modification of the blade of FIG. 2, combined with an auxiliary blowing nozzle.

For the special embodiments of the blades 8 reference is now made to FIGS. 2 and 3.

As appears from FIG. 2 each of the blades 8 comprises two thinner blades 8', having a thickness of e.g. 0.03 cm. which are mutually spaced at a distance *a*, e.g. 0.03 cm., and are integrally connected at the head ends 8*a* through a bridge portion 8*b*, which is flush with the head ends of the blades 8', as shown in FIGS. 1 and 3.

The blades 8 are mutually spaced at a distance *b*, e.g. 0.03 cm.

FIG. 3 shows an embodiment of a blade according to the invention which like the embodiment according to FIG. 2 is composed of two thinner blades but which is integrally combined with a needle-shaped auxiliary blowing nozzle. The needle-shaped auxiliary blowing nozzle 10*a* may for that purpose be simply soldered to the longitudinal edges of both elementary blades 8' as indicated at 16, or connected in a different manner.

I claim:

1. A weaving machine of the type in which weft insertion is effected by a fluid flow and in which a plurality of notched blades arranged closely adjacent each other in front of the reed confine a guide passage for the weft threads, said guide passage being laterally open towards the reed and being adapted to move into and out of the shed in synchronism with the reciprocation of the reed, characterized in that each guide passage forming blade comprises at least two spaced thin blades which are mutually connected by a relatively narrow bridge at least at the ends at which they enter and leave the weaving shed during the reed movement.

2. A weaving machine according to claim 1 in which a plurality of auxiliary blowing nozzles are provided between the weft guide passage and the reed, spaced across the weaving width, characterized in that said auxiliary blowing nozzles are each secured as a needle-shaped element to the longitudinal edge of a blade facing the reed.

* * * * *